US006947698B2

(12) United States Patent
Sawahata et al.

(10) Patent No.: US 6,947,698 B2
(45) Date of Patent: Sep. 20, 2005

(54) FIXING APPARATUS OF ELECTROPHOTOGRAPHIC PRINTER

(75) Inventors: Sho Sawahata, Ibaraki (JP); Shuho Yokokawa, Ibaraki (JP); Isao Nakajima, Ibaraki (JP); Tsukasa Onose, Ibaraki (JP); Ken Onodera, Ibaraki (JP); Yasuhide Nakazawa, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 104 days.

(21) Appl. No.: 10/726,676

(22) Filed: Dec. 4, 2003

(65) Prior Publication Data

US 2004/0109710 A1 Jun. 10, 2004

(30) Foreign Application Priority Data

Dec. 6, 2002 (JP) ..... P.2002-354854

(51) Int. Cl.[7] ..... G03G 15/20

(52) U.S. Cl. ..... 399/324; 430/124

(58) Field of Search ..... 399/320, 324, 399/325, 328; 430/124; 492/17, 18

(56) References Cited

U.S. PATENT DOCUMENTS 6,668,150 B2 * 12/2003 Toyoda et al. ..... 399/325
6,743,561 B2 * 6/2004 Heeks et al. ..... 430/124

FOREIGN PATENT DOCUMENTS

JP 4-230784 8/1992

* cited by examiner

*Primary Examiner*—Hoan Tran
(74) *Attorney, Agent, or Firm*—McGinn & Gibb, PLLC

(57) ABSTRACT

A fixing apparatus employs a dimethylsilicone oil as a base oil. Two kinds of the oils including amino group as a functional group are mixed to use as a lubricant, thereby enabling the surface of a heating roller to exhibit the most excellent releasing property with respect to a toner as well as realize low running cost.

2 Claims, 2 Drawing Sheets

FIXING APPARATUS OF ELECTROPHOTOGRAPHIC PRINTER

BACKGROUND OF THE INVENTION

1. Field of the Invention

The present invention relates to a fixing method and a fixing apparatus of an electrophotographic printer which has a pair of fixing rollers pressing each other, and passes a medium carrying a non-fixed toner image through between the pair of fixing rollers, thereby to fix the non-fixed toner image onto the medium, and more in particular to a fixing apparatus with an improved mold releasing property of a toner with respect to rollers for performing a fixation economically.

2. Description of the Related Art

As shown in FIG. 1, conventionally, in the fixing apparatus of a super high speed electrophotographic printer in response to continuous paper sheets, a toner image formed (image electrostatically transferred) on a blank paper sheet 1 is heated, pressed and fixed on the paper sheet by a heating roller 3 and a pressing roller 4, the heating roller 3 having a heating source 2 in an interior thereof and rotating in a direction of feeding the paper 1, and the pressing roller 4 being urged to the heating roller 3.

As a supplying unit for supplying a lubricant for preventing toner offsets to an outer circumference of the heating roller 3, for example, the lubricant in a tank 6 is supplied through a pump 7. The lubricant is forced out by the pump 7, and discharged out of a lubricant discharging part 8 having lots of holes. The discharged lubricant is impregnated in a coated stuff 5, and coated onto the heating roller 3.

As the lubricant coated on the surface of the heating roller 3, ordinarily a silicone oil is used. A coated layer of the heating roller 3 employs a rubber capable of printing high quality image or Teflon (registered trademark) resin excellent in heat resistance and abrasion resistance.

SUMMARY OF THE INVENTION

In the conventional fixing apparatus of the electrophoto graphic printer, when high speed printing exceeds, e.g., 300 pages/min (11 inch paper length/page), for securing a fixing strength in response to a ream weight of the paper sheets being higher than 90 kg, it is necessary to lengthen a preheated plate, heighten the amount of heat, prepare a plurality of heater lamps as heating sources in the heating roller in order to increase a heat capacity of each of the heater lamps, and determine a controlling temperature of the heating roller at a high temperature of limited heat resisting temperature of Teflon (registered trademark).

However, even if increasing the heat capacity, since the amount of the supplied heat per unit capable of supplying to the toner depends on the printing speed only, and is constant with respect to the ream weight of the paper sheet, such a problem is ready for occurring that a cold offset easily causes at a particular time when printing thick papers. Therefore, when printing the thick papers, it is necessary to adopt a manner of increasing the amount of coating the silicone oil supplied from the pump so as to secure a releasing property of the toner.

But, when increasing the oil coating amount in company with the high speed printing, an oil consumption amount goes up and a running cost per one sheet of the papers heightens. Then a problem is how to improve the releasing property of the toner with such an oil low in the cost and small amount.

In general, it is known to use a functional group such as carboxy, hydroxy, epoxy, amino, isocyanate, thioether, or mercapto for improving the releasing property of the toner. For example, JP-A-4-230784 discloses a case of using amino modified oil having the functional group. In this description, the releasing property of the toner can be improved, and the oil consumption amount can be reduced, but a material cost of the amino modified oil itself is expensive, and handling number of production increases, so that the oil is extremely expensive in comparison with an existing dimethylsilicone oil, and the running cost does not go down.

Further, in case two printing machines are arranged in row for carrying out the printings through a tandem system having a first machine for a surface side of the paper sheet and a second machine for a back side of the same, when temperature of a preheated plate is heightened in order to increase the fixing strength of the second machine, a problem is that the toner for printing the surface side adheres to and piles on the preheated plate of the second apparatus.

To solve the above mentioned problems, an aspect of the invention uses a mixture of a compound of formula (1) and a compound of formula (2), the mixing ratio by weight of the compound of formula (1): the compound of formula (2) being 90:10 to 99.5:0.5, so that that in regard to the toner the surface of the heating roll exhibits a most excellent mold releasing property and realizes a low running cost.

(1)

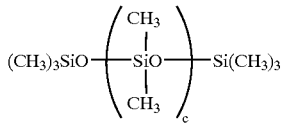

(2)

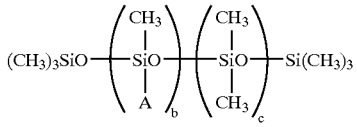

wherein

A represents $(CH_2)_3NH_2$;

b is positive number; and c is more than 1,000.

DETAILED DESCRIPTION OF THE PREFFERED EMBODIMENTS

Figure 1:
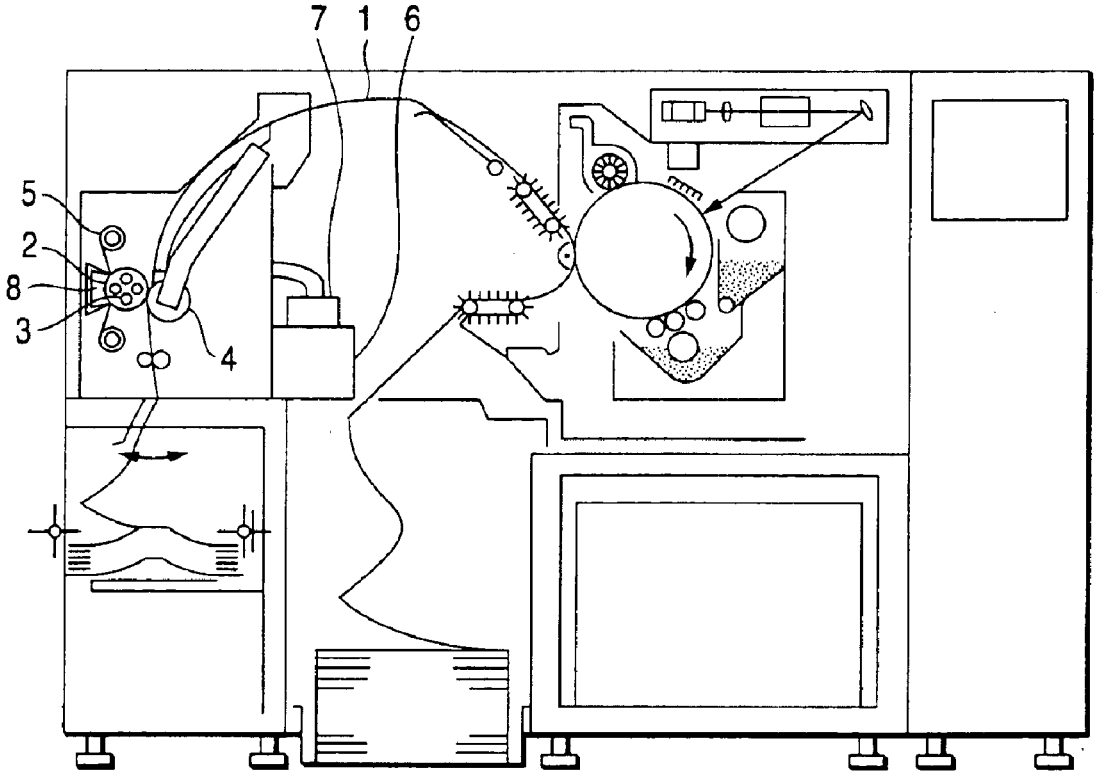
FIG. 1 is a schematic view of the electrophotographic printer.

The invention employs, as a base oil, a dimethylsilicone oil having general purposes and being cheap, so that it is possible to reduce a portion of cost-up by the amino group of high cost to the minimum, and get a mixing ratio having the most enhanced releasing property of the toner, which contain the amino group most excellent in the releasing property of the toner among functional groups.

In the above mentioned amino group-containing dimethyl polysiloxane and (1) dimethylpolysiloxane, the viscosity at 25° C. is in a range of from 10 to 10,000 CS, especially preferably 10 to 5,000 CS. Being lower than 10 CS, since volatile component much contains, it volatilizes at high temperature, so that a good effect cannot be exhibited for a long period of time. In contrast, being more than 10,000 CS, an expanding—contracting property becomes worse, and an initial mold releasing property goes down. Besides, the ratio of a compound of formula (1): a compound of formula (2)=90:10 to 99.5:0.5 is desirable, in particular 95:5 to 99.5:0.5 is more desirable. When a compound of formula (2) is less than 0.5, variation in production is large, and viscosity and performance are not stable, while being more than 10, it is economically disadvantageous and the viscosity undesirably becomes too high.

Organopolysiloxane has disadvantages that it lacks heat resistance under severe temperature conditions in comparison with a fluid of general dimethylorganopolysiloxane, and since it is affected with thermal oxidation and rapidly deteriorates, the viscosity increases and comes to a gel state, but unless leaving it at 200° C. for more than 48 hours continuously, there is no matter, and no problem occurs at around 150° C. In the fixing apparatus of the super high speed electrophotographic printer, the above mentioned oils are usually used at around 150° C. continuously, and exposed only a few seconds under the temperature condition of 200° C., and therefore even if mixing an amine gum of high viscosity such that b is positive number and c is more than 1,000, there arises no problem at all.

In case the concentration of the amino group is large (if the amine equivalent is small, the concentration of the amino group is large), since a methyl group in the oil having a strong relation with the mold releasing effect decrease, the releasing property worsens. Since the amine equivalent has an appropriate range, if a percentage of the amino group containing dimethylpolysiloxane is 0.5 to 10%, the amine equivalent desirably exceeds 500,000.

EXPERIMENTAL EXAMPLES

A description will be made to one embodiment of carrying out an experiment by use of a laser printer which was the electrophotographic printer having printing speed being 324 pages/min. Herein, since the structure of the printing apparatus is the same as that described in the existing technique other than using the lubricant of the invention, the description therefore is omitted. As the unit of supplying the lubricant to the surface of the heating roller, it is sufficient to supply the lubricant in an oil pan to the coating roller contacting the surface of the fixing roller other than a method of coating with a web or the like.

Examples and Comparative Examples used the following oils as the lubricant.

(1) Low viscosity dimethyl oil
(2) Low viscosity dimethyl oil+high viscosity dimethyl oil (the mixing ratio: 98 to 99:2 to 1)
(3) Low viscosity amino modified oil The amine equivalent had 7,500 to 50,000 CS
(4) Amino oil of the invention Herein, the low viscosity was 10 to 500 CS, and the high viscosity was 5,000 to 1,000,000 CS.

EXPERIMENTAL EXAMPLE 1

As a confirmation method of the releasing property of the toner, the offset band of 90 kg paper was measured by making the determined temperature of the preheated plate constant and varying the temperature of the heating roller from 120° C. to 220° C. When performing the experiment, used were a styrene acrylic toner, a polyester toner and the heating roller coated with Teflon (registered trademark) layer.

Results are as shown in the Table 1. As to the hot offset, each of the oils secured the temperature of more than 220° C. at levels of no problem, while as to the cold offset, the amino oil of the invention had the widest offset band. This is considered to have an effect that the amino group as the functional group was easily adhered to the surface of the heating roller, as well as an effect of causing the dimethyl oil to adhere to the surface of the heating roller. Further, when the concentration of the amino group was too high, it was resulted that the methyl group in the oil having the strong relation with the releasing effect decreased, and the releasing property worsened.

TABLE 1

| Mold releasing agent | Low viscosity dimethyl oil (1) | Low viscosity dimethyl oil + High viscosity dimethyl oil (2) | Low viscosity amino modified oil (3) | Amino oil of the invention (4) |
|---|---|---|---|---|
| A | | | | |
| 120 | x | x | x | x |
| 130 | x | x | x | x |
| 140 | x | x | x | ○ |
| 150 | x | x | ○ | ○ |
| 160 | x | ○ | ○ | ○ |
| 170 | ○ | ○ | ○ | ○ |
| 180 | ○ | ○ | ○ | ○ |
| 190 | ○ | ○ | ○ | ○ |
| 200 | ○ | ○ | ○ | ○ |
| 210 | ○ | ○ | ○ | ○ |
| 220 | ○ | ○ | ○ | ○ |

A: Temperature (° C.) of heating rollers

Herein, this experiment set the determined temperature of the preheated plate to be 90/120° C. But, for example, since the offset band depends on the determined temperature of the preheated plate, in case the temperature of the preheated plate is decreased or in case the paper sheets containing the high water content or having the high ream weight are used, the temperature of the cold offset goes up.

Further, owing to difference of a height of toner adhesion paper on the printing surface caused by difference in printing patterns, or variations of papers and paper transporting properties, the temperature of the cold offset is varied. For securing a desired fixing strength, the heating roller is ordinarily arranged separately as far as possible from the temperature of the offset. Accordingly, this experimental manner is an effective procedure for relatively comparing the releasing properties of toners of respective kinds of oils.

EXPERIMENTAL EXAMPLE 2

Based on the results of Experimental Example 1, actual printings were exercised with 90 kg papers. Under the same conditions in the oil coating amounts to the heating rollers, the oil of the invention showed best results in both of off set at felt, and fuse grade by tapes peeling test.

Figure 2:
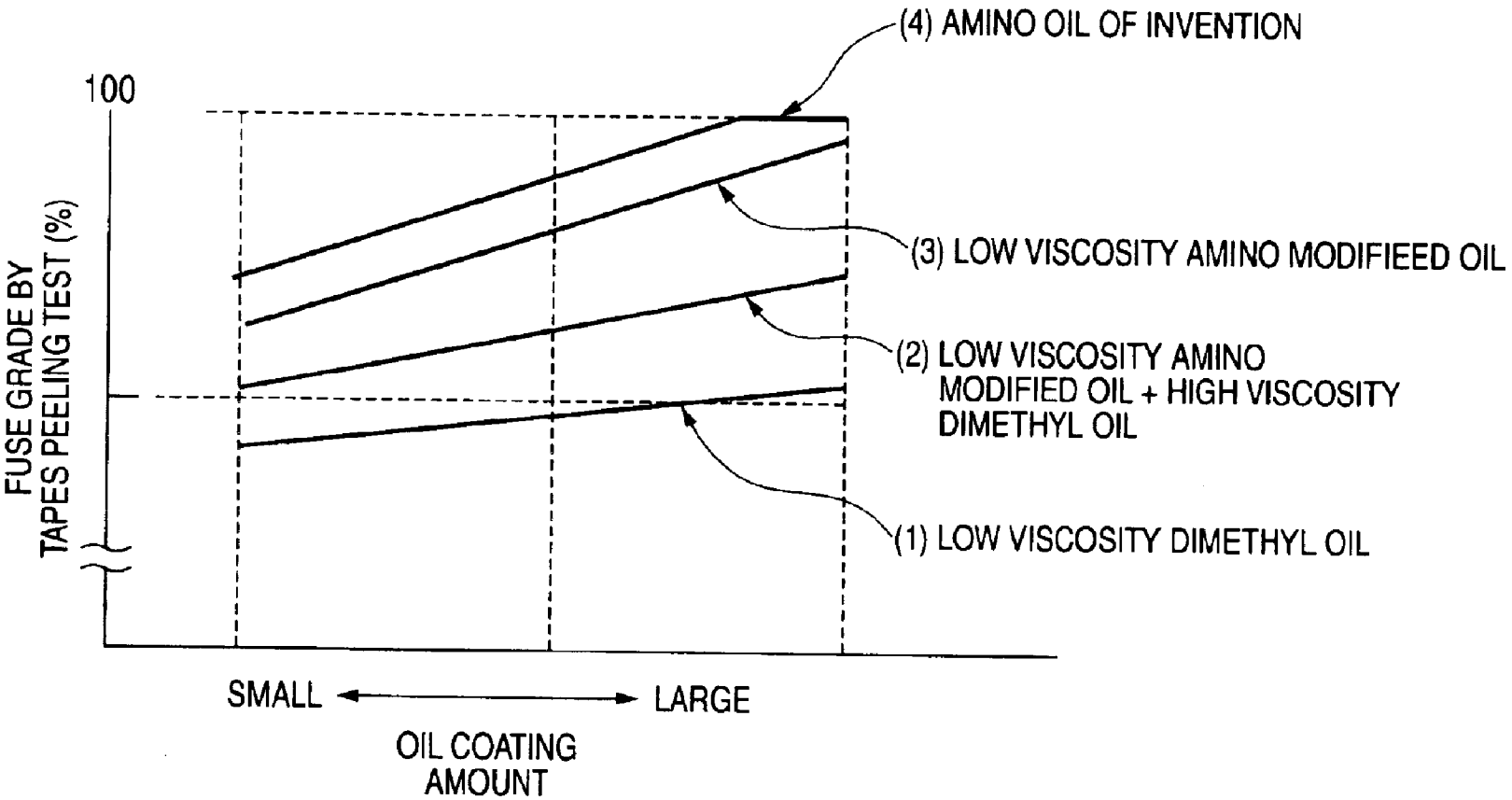
FIG. 2 is a graph showing relationship between fuse grade by tapes peeling test and amount of respective oils.

Furthermore, when the oil coating amounts were varied for confirming the actual machines, the oil of the invention showed the results as shown in FIG. 2. In comparison with the dimethyl oil, the more the oil amount increased, the more the fuse grade by tapes peeling test heightened and the releasing property of the toner went up.

EXPERIMENTAL EXAMPLE 3

Two machine were arranged in row for carrying out the printings on both of the surface side and the back side of the paper sheet through the tandem system of ream weight being 55 kg by setting the temperature of the heat preheated plate at 70/100° C., resulting in that the toner adhering amount on the preheated plate of the second machine had the following relation of (4) oil<(3) oil<(2) oil<(1) oil.

Accordingly, using the oil of the invention, it is possible to heighten the set temperature of the preheated plate, and contribute to securing the fixing strength of the second machine.

Theses results are consistent with those of the offset band, and it is considered that the amino group as the functional group begins to adhere to the surface of the preheated plate and forms a thin oil layer, and increases the releasing property of the toner from the papers during continuously printing.

Besides, comparison of the cost of the respective lubricants will be described below.

Cheap←(1) oil<(2) oil<(4) oil<<(3) oil→expensive. When using (4) oil of the invention, the releasing property of the toner increases. Therefore, the amount of supplying (4) oil can be reduced below ½ in comparison with the amount of supplying (2) oil, and a page cost per one page is made lowest.

According to the fixing method and the fixing apparatus of the invention, the surface of the heating roller can exhibit the most excellent releasing effect with respect to the toner, the amount of supplying oil can be reduced remarkably, and the running cost can be decreased.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fixing apparatus of an electrophotographic printer comprising:

a pair of fixing rollers which presses each other, wherein a medium carrying non-fixed toner image thereon passes through between the rollers, thereby to fix the non-fixed toner image onto the medium, a supplying unit for supplying a amino group-containing silicone oil lubricant for fixing to at least one of the fixing rollers, wherein the at least one of the fixing rollers includes a fixing roller contacting a non-fixed toner image;

wherein the amino group-containing silicone oil lubricant for fixing has a viscosity at 25° C. of 10~5000 cs and comprises a mixture of a compound of formula (1) and a compound of formula (2), the mixing ratio by weight of the compound of formula (1): the compound of formula (2) being 90:10 to 99.5:0.5, (1)

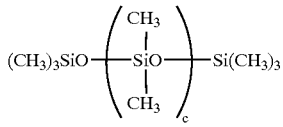

(2)

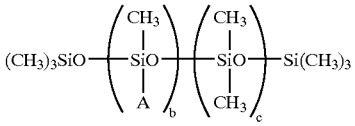

wherein

A represents $(CH_2)_3NH_2$;

b is positive number; and c is more than 1,000.

2. A fixing apparatus of an electrophotographic printer according to 1, wherein the amino-group containing dimethylpolysiloxane has an amino equivalent exceeding 500,000.

* * * * *